US005253769A

United States Patent [19]

Vlastakis

[11] Patent Number: 5,253,769

[45] Date of Patent: Oct. 19, 1993

[54] TRAY DESIGN FOR MERCHANDISE DISPLAY DEVICE

[75] Inventor: Kirk A. Vlastakis, Clemmons, N.C.

[73] Assignee: Alliance Display and Packaging Company, Winston-Salem, N.C.

[21] Appl. No.: 881,874

[22] Filed: May 12, 1992

[51] Int. Cl.[5] ..... A47F 7/00

[52] U.S. Cl. ..... 211/126; 211/132

[58] Field of Search ..... 211/126, 132, 72; 248/174

[56] References Cited

U.S. PATENT DOCUMENTS

| | | | |
|---|---|---|---|
| 2,142,883 | 1/1939 | Chaney et al. | 211/72 |
| 3,696,940 | 10/1972 | Hoffman et al. | 211/126 |
| 3,784,083 | 1/1974 | Pfaffendorf et al. | 211/126 |
| 4,506,790 | 3/1985 | Muscari | 211/59.4 |
| 4,512,541 | 4/1985 | Lietzke | 248/174 |
| 4,530,548 | 7/1985 | Spamer et al. | 211/72 |
| 4,579,232 | 4/1986 | Fedak | 211/132 |

*Primary Examiner*—Mark Rosenbaum
*Assistant Examiner*—Chuck Y. Mah
*Attorney, Agent, or Firm*—Herbert J. Bluhm

[57] ABSTRACT

A tray or shelf fabricated from corrugated board and designed for use in a merchandise display device is disclosed. The tray includes a folded section that forms the front wall and opposing side walls of the tray and provides improved strength. The bottom panel member of the tray which supports the merchandise being displayed is also strengthened by a bottom-reinforcing panel disposed beneath the bottom panel member. The tray may be optionally provided with one or more dividers for merchandise display purposes and in a preferred embodiment, a tray divider is provided by modifying the unitary blank from which the tray is formed. Two or more trays are preferably installed in suitable support means designed to hold the trays in a vertically spaced manner.

25 Claims, 6 Drawing Sheets

TRAY DESIGN FOR MERCHANDISE DISPLAY DEVICE

FIELD OF THE INVENTION

This invention relates to a tray or shelf design for holding products in a merchandise display device.

BACKGROUND OF THE INVENTION

Merchandise display devices are frequently used to provide an attractive setting for a product to be sold as well as for a functional arrangement that will facilitate handling of the product. Such display devices are used in supermarkets, discount department stores and other sales outlets and are designed so that they occupy only limited floor space. The devices are usually fabricated from cardboard or similar inexpensive materials and they are generally designed for displaying a particular product or a limited group of products. These devices typically employ several trays or shelves arranged in a stacked or tiered manner in order to accommodate the maximum amount of merchandise with a minimum of floor space required for the device. Since such display devices may be shipped to the sales outlets in knock-down form, it is desirable for them to be designed so that assembly can be quickly and easily accomplished. An example of a merchandise display device is disclosed in U.S. Pat. No. 4,506,790 wherein multiple shelves are employed for supporting the product.

SUMMARY OF THE INVENTION

The present invention provides a shelf or tray design that is intended for use with suitable support means that are capable of accommodating two or more trays arranged in a vertically spaced manner. The tray is of unitary construction and includes front and side walls for retaining product on the tray even when the tray is positioned with the front edge of the tray at a lower elevation than the rear edge of the tray.

It is an object of the present invention to provide a tray for a merchandise display device wherein opposing side walls are continuous with the front wall of the tray and the front and side walls comprise a folded panel of corrugated board for increased structural strength.

The disclosed tray includes a bottom panel member having opposing first and second side edges and opposing front and rear edges, a bottom-reinforcing panel designed to underlie at least a portion of said bottom panel member with the front edge of the bottom-reinforcing panel being essentially parallel to and adjacent to the front edge of the bottom panel member. An elongated panel folded along its longitudinal axis is disposed between and attached to the front edges of the bottom panel member and bottom-reinforcing panel with the folded elongated panel extending along the entire length of the front edge of the bottom panel member and forming the front wall of the tray. The tray also includes first and second side walls comprising folded sections that are continuous with the folded elongated panel extending along the front edge of the bottom panel member with the side walls being positioned in abutting relationship to the respective first and second side edges of the bottom panel member. Both the front wall and the first and second side walls project generally upwardly a predetermined distance to retain the particular product that is supported by the bottom panel member. Attached, respectively, to the first and second side walls are first and second locking panels which extend a predetermined distance beneath the bottom panel member and serve to maintain the first and second side walls and the front wall in an upwardly projecting position. Attached to the first and second side walls, respectively, are first and second connecting panels which are also attached to opposing side edges of the bottom-reinforcing panel and are provided with score lines to permit the connecting panels to be folded as the connecting panels and the bottom-reinforcing panel are positioned beneath the locking panels and the bottom panel member.

It is a further object of this invention to provide a unitary blank of material which is predesigned to fold into the tray described above. In a preferred embodiment of the invention, the predesigned blank is provided with a layer of adhesive adjacent to the longitudinal axis of the elongated panel so that the elongated panel will be maintained in folded form prior to erecting the tray from the blank.

Yet another object of this invention is to provide a tray with a merchandise-supporting bottom panel member having one or more slots designed to accommodate tabs protruding through the slots which serve as dividers in the tray.

These and other objectives will be apparent from the attached drawings and detailed description which follows.

DESCRIPTION OF THE PREFERRED EMBODIMENTS

Figure 1:
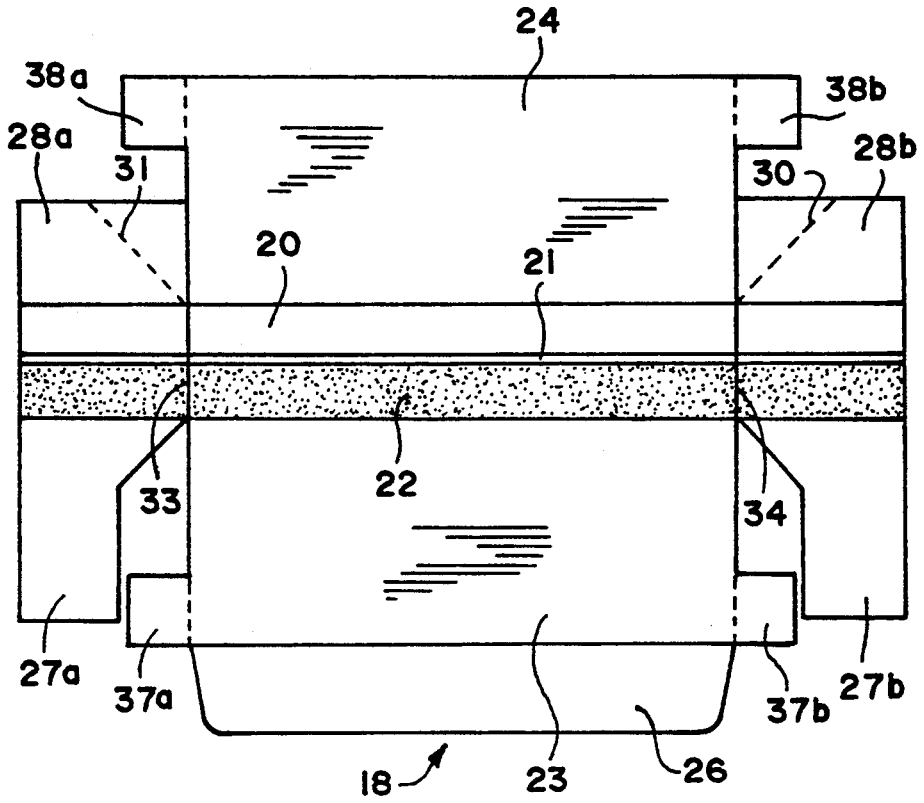
FIG. 1 is a plan view of a blank used for forming a tray in accordance with one embodiment of the invention.
Figure 2:
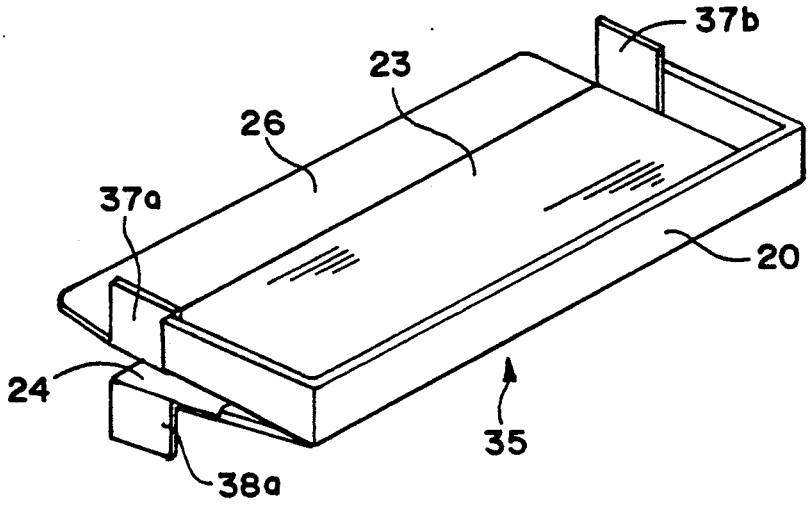
FIG. 2 is a perspective view of the tray that is formed from the blank shown in FIG. 1.

With reference to the drawings, the blank 18 shown in FIG. 1 is formed into tray 35 shown in FIG. 2. As can be seen from the view of the underside surface of blank 18 in FIG. 1, elongated panel 20 extends along the entire length of the blank and is provided with a weakened zone 21 that coincides essentially with the longitudinal axis of elongated panel 20. The folding of elongated panel 20 along its longitudinal axis is facilitated by weakened zone 21 and folded panel 20 forms the front and side walls of the tray as shown in FIG. 2. Hingedly attached to opposing edges in the central portion of elongated panel 20 are bottom panel member 23 and bottom-reinforcing panel 24. Locking panels 27*a* and 27*b* are attached to either end of elongated panel 20 adjacent to bottom panel member 23 and connecting panels 28*a* and 28*b* are attached to elongated panel 20 opposite to locking panels 27*a* and 27*b*, respectively. Connecting panels 28*a* and 28*b* are also attached to opposing side edges of bottom-reinforcing panel 24 and are provided with weakened zones 30 and 31. Back panel 26 is hingedly attached to the rear edge of bottom panel member 23.

Figure 13:
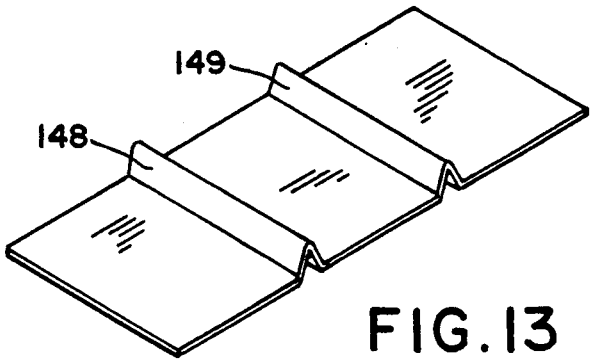
FIG. 13 is a perspective view of a "drop-in" tray divider suitable for use with certain embodiments of the invention.

Formation of tray 35 from blank 18 involves folding of elongated panel 20 along weakened zone 21 and positioning the folded panel at an angle of approximately 90 degrees with respect to the plane of bottom panel member 23. Locking panels 27*a* and 27*b* are then moved to a position beneath and in contact with bottom panel member 23 until each end of folded elongated panel 20 is in abutting relationship with the respective side edge of bottom panel member 23. This movement is facilitated by score lines 33 and 34 in folded elongated panel 20. Finally, bottom-reinforcing panel 24 is moved to a position beneath bottom panel member 23 (see FIG. 2) and locking panels 27*a* and 27*b* with the simultaneous folding inwardly of connecting panels 28*a* and 28*b* along weakened zones 30 and 31 to produce the formed tray 35. Suitable fasteners such as staples may be used at strategic locations to maintain the tray in its formed configuration. Instead of using fasteners the tray is preferably installed in a suitable merchandise display device that is designed to hold the tray in its formed configuration. Optional mounting tabs 37*a* and 37*b* as well as 38*a* and 38*b* attached, respectively, to panels 23 and 24 are preferably employed to engage suitable retainers associated with a merchandise display device so that the tray will be held securely in the desired position by the device. Also, it is preferred that a layer of adhesive 22 be applied to elongated panel 20 in order to maintain elongated panel 20 in its folded state before formation of the tray is completed. It is apparent that the height of the front and side walls of tray 35 will be approximately one half the transverse dimension of elongated panel 20. Thus, the height of the walls can be made to accommodate most effectively the size and nature of the particular product to be displayed on the tray. If desired, tray 35 may be provided with a product divider such as the separate "drop-in" design shown in FIG. 13 which has upwardly projecting dividers 148 and 149 incorporated therein.

Figure 3:
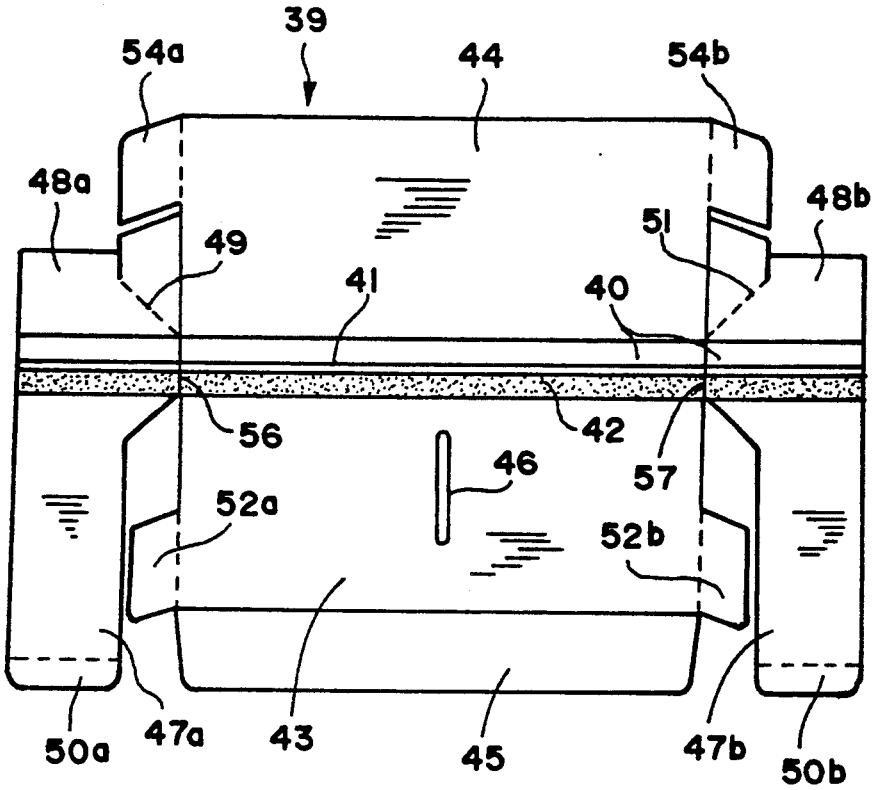
FIG. 3 is a plan view of a blank used for forming a tray in accordance with another embodiment of the invention.
Figure 4:
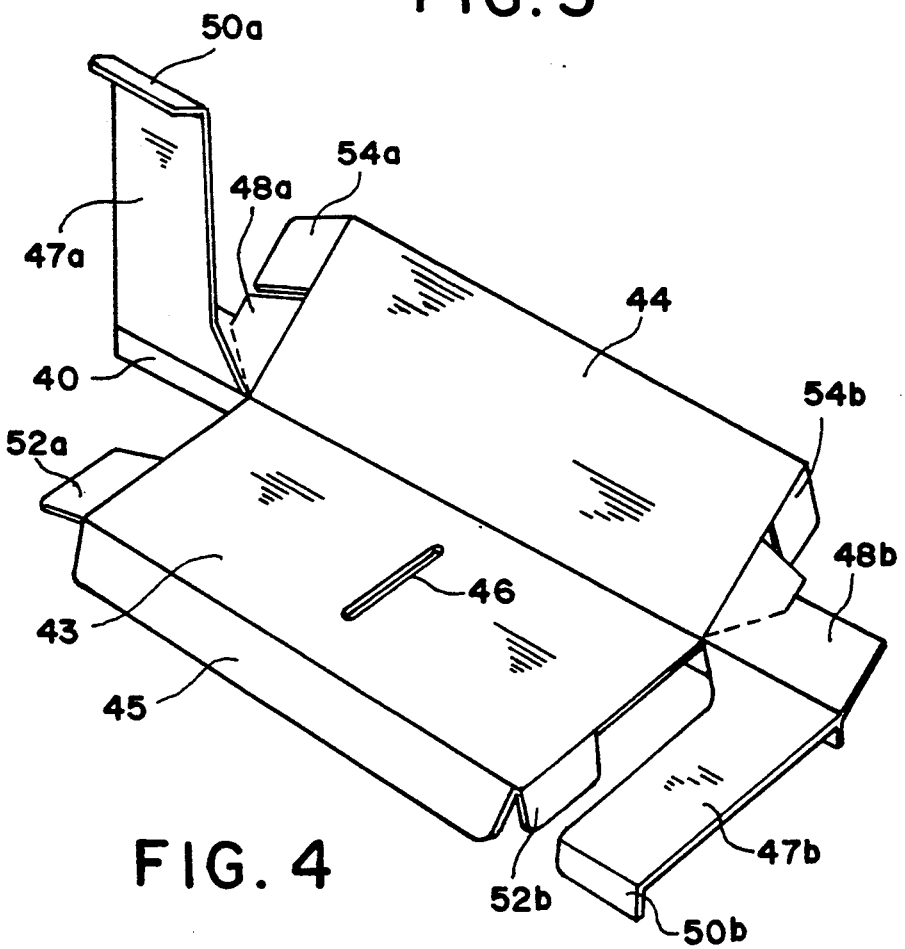
FIG. 4 is a perspective view of the blank of FIG. 3 showing details of the manner in which the tray is formed.
Figure 5:
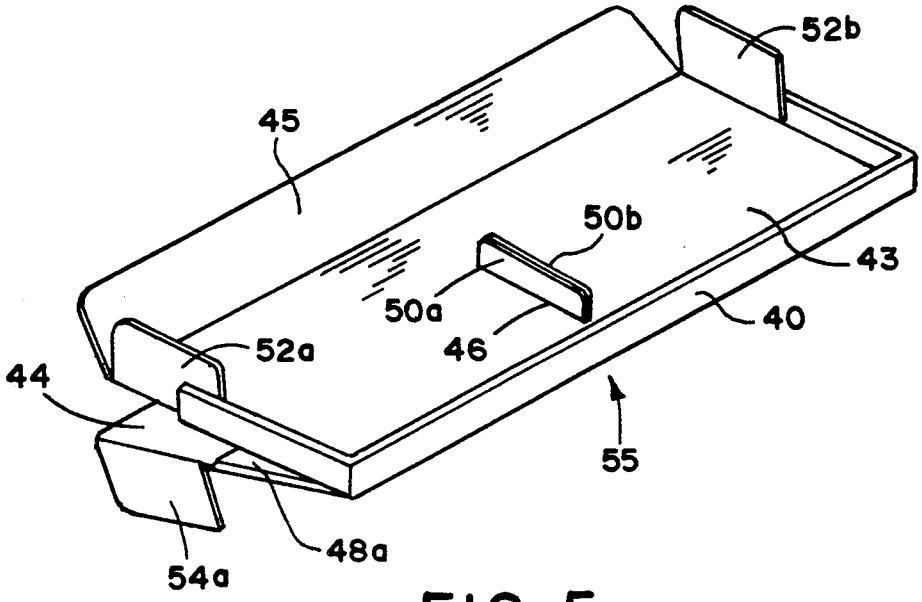
FIG. 5 is a perspective view of the tray that is formed from the blank shown in FIG. 3.
Figure 12:
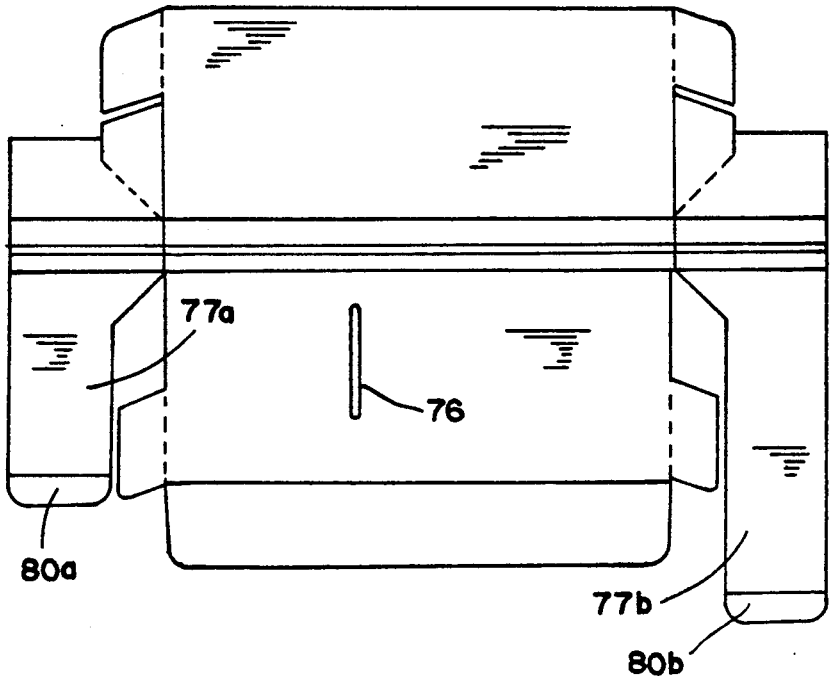
FIG. 12 is a plan view of a blank used for forming a tray in accordance with yet another embodiment of the invention.

Another embodiment of the present invention is shown in FIGS. 3, 4 and 5. The underside surface of blank 39 is shown in FIG. 3 and the blank includes panels 40, 43, 44, 47*a*, 47*b*, 48*a* and 48*b* which correspond, respectively, to panels 20, 23, 24, 27*a*, 27*b*, 28*a* and 28*b* in FIG. 1. Connecting panels 48*a* and 48*b* are provided with weakened zones 49 and 51 to facilitate folding of those panels in the formation of a tray from blank 39. Additionally, back panel 45 is hingedly attached to the rear edge of bottom panel member 43 and is designed to cooperate with support means associated with the merchandise display device in which the formed tray 55 (FIG. 5) is used. Score lines 56 and 57 facilitate the bending of folded elongated panel 40 during formation of tray 55. Bottom panel member 43 is provided with slot 46 whose longitudinal axis is essentially perpendicular to the front edge of bottom panel 43 and is designed to accommodate tabs 50*a* and 50*b* attached to locking panels 47*a* and 47*b*, respectively. As seen in FIG. 5, tabs 50*a* and 50*b* protrude through slot 46 and together serve as a tray divider for the product or products displayed. The location of this tray divider may be moved by modifying the dimensions of the locking panels as shown in FIG. 12. Thus, locking panel 77*a* is shortened while locking panel 77*b* is lengthened and slot 76 is correspondingly relocated to accommodate tabs 80*a* and 80*b* when the blank is converted into a formed tray.

It is preferred that a layer of adhesive 42 be applied to elongated panel 40 (see FIG. 3) prior to folding panel 40 along weakened zone 41. This embodiment of the invention also includes mounting tabs 54*a* and 54*b* which are hingedly attached to opposing side edges of bottom-reinforcing panel 44 and mounting tabs 52*a* and 52*b* which are hingedly attached to opposing side edges of bottom panel member 43. These mounting tabs are designed to cooperate with appropriate support means which hold the tray in a desired position in a merchandise display device.

Figure 6:
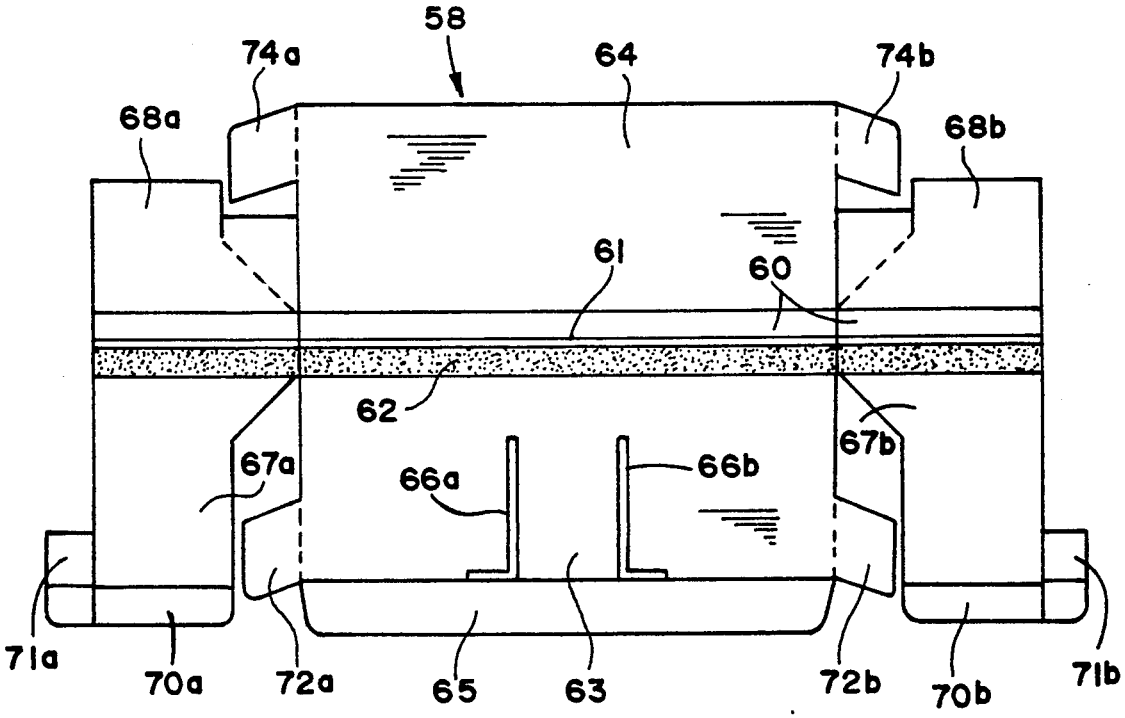
FIG. 6 is a plan view of a blank used for forming a tray in accordance with yet another embodiment of the invention.

The embodiment shown in FIG. 6 is similar to that depicted in FIGS. 3, 4 and 5 except that bottom panel member 63 is provided with two L-shaped slots 66*a* and 66*b* which are designed to receive tabs 70*a* and 70*b*, respectively. Tabs 70*a* and 70*b* assume the L-shaped configuration of slots 66*a* and 66*b* while tabs 71*a* and 71*b* are sandwiched between locking panels 67*a* and 67*b*, respectively, and bottom-reinforcing panel 64 in the tray that is formed from blank 58. Thus, tabs 70*a* and 70*b* serve as dividers in the formed tray and their upwardly projecting position is maintained by tabs 71*a* and 71*b*, respectively. It should be noted that the location of slots 66*a* and 66*b* can be changed by making corresponding changes in the design of locking tabs 67*a* and 67*b*, respectively. The functions of panels 60, 63, 64, 65, 67*a*, 67*b*, 68*a* and 68*b* are analogous to those of panels 40, 43, 44, 45, 47*a*, 47*b*, 48*a* and 48*b* in the blank shown in FIG. 3. Also, weakened zone 61, adhesive layer 62 and mounting tabs 72*a*, 72*b*, 74*a* and 74*b* serve to facilitate, respectively, the conversion of elongated panel 60 to its folded state and the installation of the formed tray in a merchandise display device.

Figure 7:
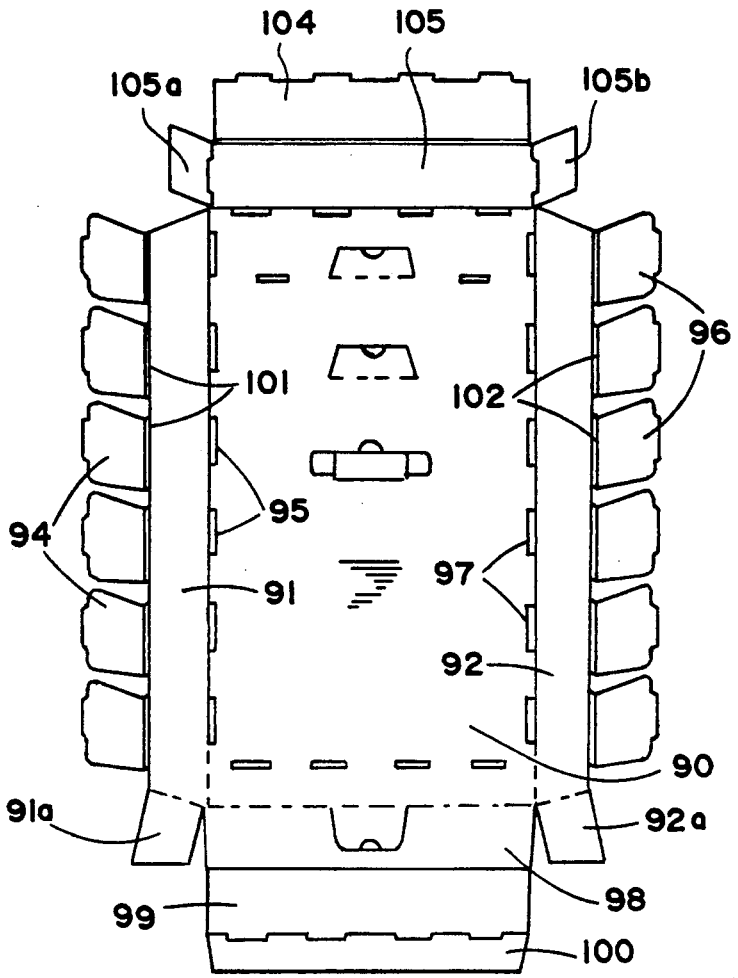
FIG. 7 is a plan view of a blank used for forming a merchandise display device designed to hold trays formed in accordance with the invention.
Figure 8:
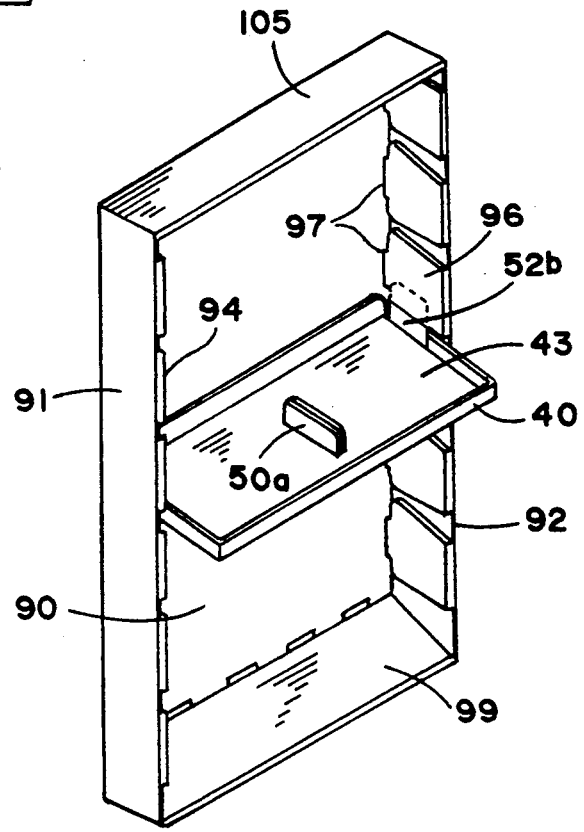
FIG. 8 is a perspective view of a merchandise display device formed from the blank shown in FIG. 7 and holding a formed tray in accordance with FIG. 5.

Shown in FIGS. 7 and 8 is one type of support stand which can be used to hold a number of trays in vertically spaced fashion. The blank shown in FIG. 7 includes a back panel 90, opposing side walls 91 and 92, and locking panel extensions 91*a* and 92*a* which are designed to engage a folded base assembly comprising panels 98, 99 and 100. Side walls 91 and 92 are each provided with hingedly attached and vertically spaced flaps 94 and 96 which are designed to be folded inwardly along weakened zones 101 and 102 into a locked position (see FIG. 8) by means of cooperating slots 95 and 97 and projections on each of flaps 94 and 96. Panel 104 is hingedly attached to panel 105 and is designed to fold inwardly into a locked position to form the top of the support stand. Locking panel extensions 105*a* and 105*b* are designed to engage the side wall assemblies. For purposes of illustration, only one tray is shown in the assembled merchandise display device of FIG. 8. It will be seen, however, that up to five trays can be installed in the device. A tray in accordance with FIG. 5 is shown in the installed position in FIG. 8. The preassembled tray is positioned in the spaces between adjacent vertically spaced flaps 94 and 96 with mounting tabs 52*a* and 54*a* (see FIG. 5) being disposed between side wall 91 and adjacent flaps 94 while mounting tabs 52*b* and 54*b* (see FIGS. 4 and 5) are disposed between side wall 92 and adjacent flaps 96 (see FIG. 8). It should be noted that the principal support for the formed tray in the support stand is provided by the upper edges of the flaps 94 and 96 on which the tray is installed. Thus, the upper edges of flaps 94 and 96 can be designed to support the tray in an essentially horizontal position or in an inclined position. Depending on the tray position desired, the lower edge of each flap 94 and 96 is designed to cooperate with the upper edge of the adjacent flap 94 or 96. In the embodiment shown in FIGS. 7 and 8, the upper and lower edges of flaps 94 and 96 are designed to support the tray in an inclined position so that the front edge of the tray is at a slightly lower elevation than its rear edge. This allows product displayed on the tray to move toward the front wall of the tray by gravitational forces.

Figure 9:
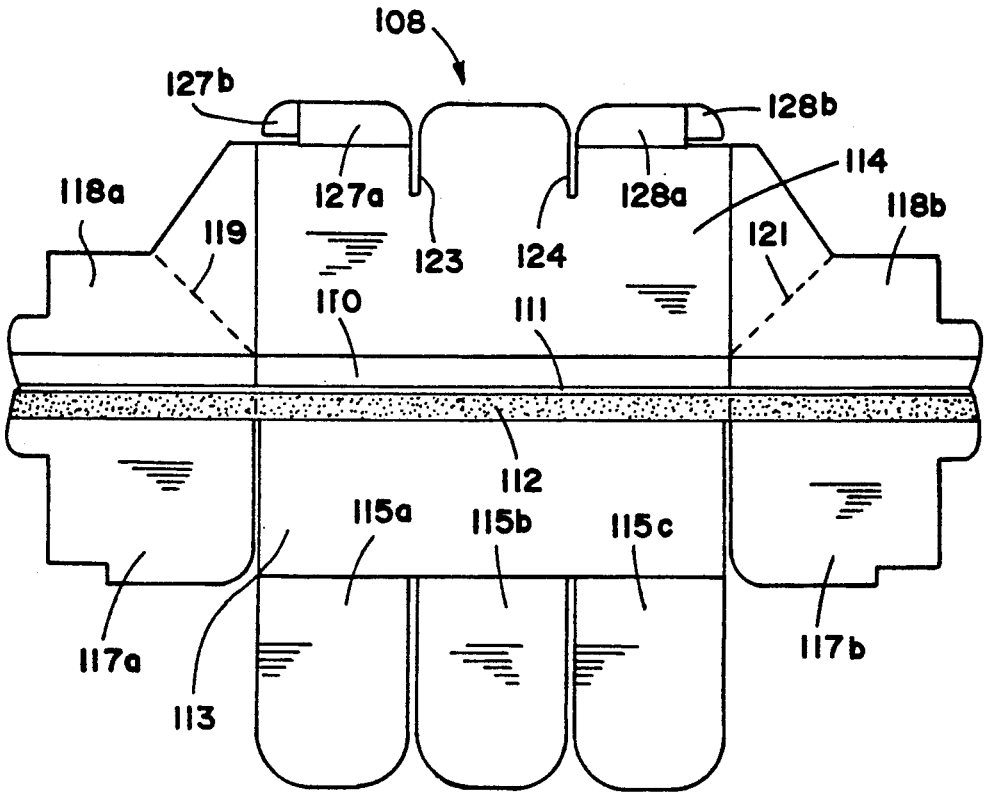
FIG. 9 is a plan view of a blank used for forming a tray in accordance with a further embodiment of the invention.
Figure 10:
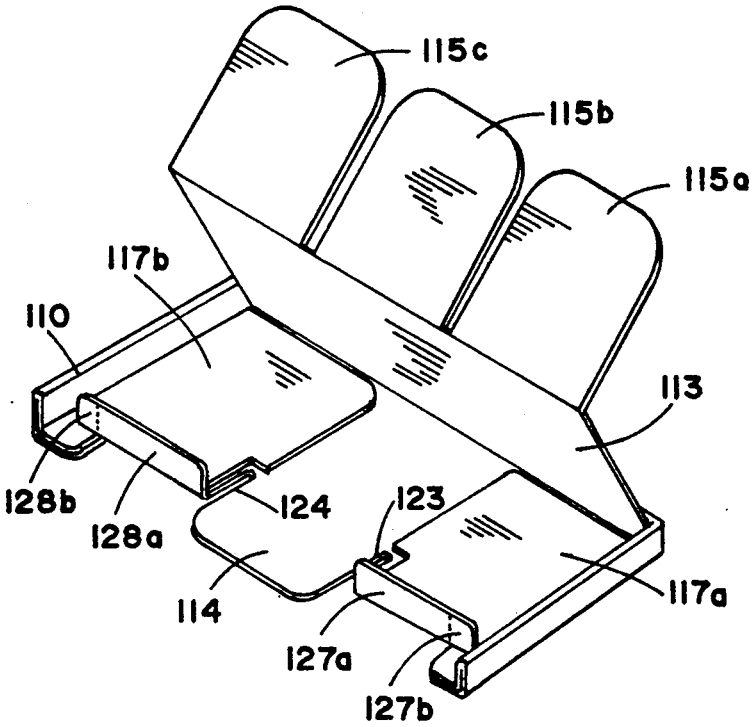
FIG. 10 is a perspective view of a tray formed from the blank of FIG. 9 showing details of the tray design.

A further embodiment of this invention is shown in FIGS. 9 and 10. The view of the underside surface of blank 108 in FIG. 9 includes elongated panel 110 with weakened zone 111 and an optional layer of adhesive 112 to facilitate maintaining elongated panel 110 in a folded state. Bottom panel member 113 has hingedly attached thereto back panels 115*a*, 115*b* and 115*c* with the narrow gap between adjacent back panels being sufficient to allow intermeshing with cooperating support means associated with a merchandise display device. The rear edge of bottom-reinforcing panel 114 is provided with two spaced apart slots 123 and 124 extending inwardly from the rear edge of panel 114. Hingedly attached to the rear edge of bottom-reinforcing panel 114 are tabs 127*a* and 128*a* which have ends 127*b* and 128*b* severed from the rear edge of panel 114. Locking panels 117*a* and 117*b* and connecting panels 118*a* and 118*b* with weakened zones 119 and 121 are analogous to panels 47*a* and 47*b* and panels 48*a* and 48*b*, respectively, in the embodiment shown in FIG. 3. When blank 108 is formed into a tray, slot 123 moves into alignment with the narrow gap between back panels 115*a* and 115*b* and slot 124 moves into alignment with the narrow gap between back panels 115*b* and 115*c*. Also, bottom-reinforcing panel 114 is held in position in the formed tray by moving tab ends 127*b* and 128*b* into contact with the upper surface of locking panels 117*a* and 117*b*, respectively, as shown in FIG. 10. The formed tray is then inserted into a support stand such as the one depicted in FIG. 11.

Figure 11:
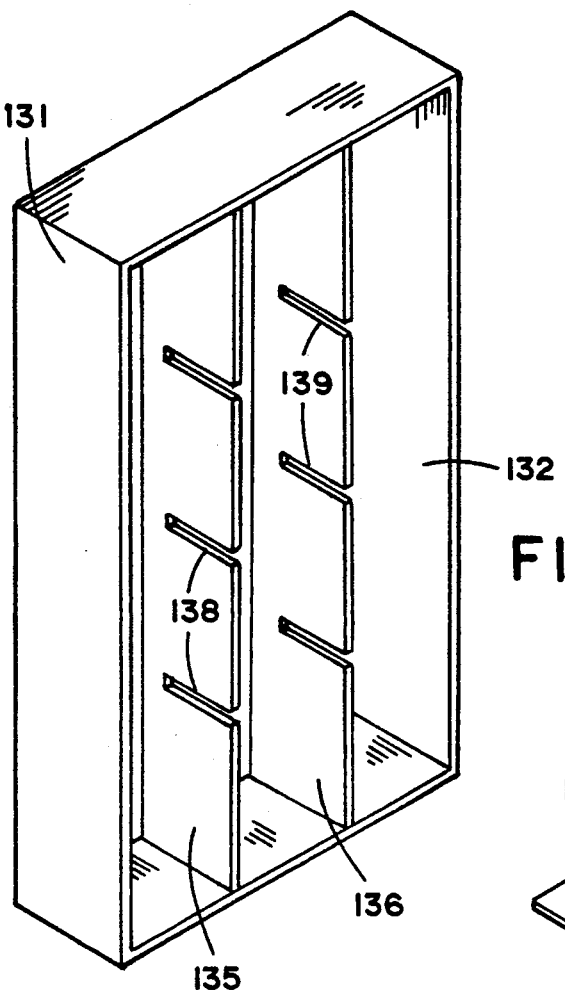
FIG. 11 is a perspective view of a merchandise display device designed to hold trays of the type shown in FIG. 10.

The merchandise display device of FIG. 11 includes two vertical support members 135 and 136 disposed between side walls 131 and 132. Vertical support members 135 and 136 are provided with vertically spaced slots 138 and 139, respectively, which extend rearwardly from the front edges of support members 135 and 136. Slots 123 and 124 of the formed tray shown in FIG. 10 are brought into alignment with slots 138 and 139 of vertical support members 135 and 136 and the tray is pushed into the support stand so that portions of bottom panel member 113 and bottom-reinforcing panel 114 penetrate into slots 138 and 139 where they are securely held by the confining edges of those slots. The merchandise display device shown in FIG. 11 is designed to accommodate three trays but it is apparent that the device can be designed to hold any number of trays desired. Since the trays are held in place primarily by the confining edges of slots 138 and 139, it is evident that the dimensions of those slots should approximate the combined thickness of the formed tray portions that enter slots 138 and 139. The dimensions of the narrow gaps between back panels 115*a*, 115*b* and 115*c* of the formed tray should have minimum transverse measurements that approximate the thickness of vertical support members 135 and 136.

Each of the preferred embodiments described above is fabricated from corrugated board or boxboard. When adhesives are employed in connection with the folding of the elongated panels of each blank, either aqueous or non-aqueous adhesives may be used. Aqueous formulations include those based on starch or dextrins and non-aqueous formulations include those based on synthetic resins. Particularly preferred are hot-melt adhesives which are capable of forming strong bonds quickly when they are activated.

While several embodiments of the present invention have been described above, it is apparent that other modifications can readily be made based on the teachings contained herein. Any such modifications are deemed to be a part of this invention as defined by the scope of the appended claims.

What is claimed is:

1. A tray suitable for holding product in a merchandise display device, said tray being constructed from corrugated board and comprising a) a bottom panel member for supporting product, said bottom panel member having opposing first and second side edges and opposing front and rear edges, b) a bottom-reinforcing panel designed to underlie at least a portion of said bottom panel member, said bottom-reinforcing panel having a rear edge, two opposing side edges and a front edge that is essentially parallel to and adjacent to the front edge of said bottom panel member, c) an elongated panel folded along its longitudinal axis and disposed between and attached to the front edge of said bottom panel member and the front edge of said bottom-reinforcing panel, said folded elongated panel extending along the entire length of the front edge of the bottom panel member and projecting generally upwardly a predetermined distance to form a front wall of said tray, d) first and second side walls projecting generally upwardly and positioned in abutting relationship to the respective first and second side edges of the bottom panel member, said first and second side walls comprising folded sections that are continuous with the folded elongated panel extending along the front edge of the bottom panel member, e) first and second locking panels attached to said first and second side walls, respectively, and extending a predetermined distance beneath the bottom panel member, and f) first and second connecting panels attached to said first and second side walls, respectively, and to opposing side edges of said bottom-reinforcing panel, each of said connecting panels being folded and, together with the attached bottom-reinforcing panel, being positioned beneath said locking panels and said bottom panel member.

2. A tray in accordance with claim 1 wherein the folded elongated panel forming the front wall and the first and second side walls is provided with a layer of adhesive on the surfaces of the folded elongated panel that are brought into contact by folding the panel along its longitudinal axis.

3. A tray in accordance with claim 2 wherein each of said opposing side edges of the bottom-reinforcing panel and each of said opposing first and second side edges of the bottom panel member is provided with an attached mounting tab, said attached mounting tabs being designed to engage support means associated with said merchandise display device for holding the tray in a desired position.

4. A tray in accordance with claim 3 wherein the rear edge of said bottom panel member has hingedly attached thereto a back panel designed to cooperate with support means associated with said merchandise display device for displaying product placed in the tray.

5. A tray in accordance with claim 2 wherein the rear edge of said bottom panel member has hingedly attached thereto a plurality of back panels designed to cooperate with support means associated with said merchandise display device for displaying product placed in the tray.

6. A tray in accordance with claim 5 wherein said bottom-reinforcing panel is provided with a plurality of slots extending inwardly from the rear edge of the bottom-reinforcing panel, said slots being adapted to engage support means associated with said merchandise display device.

7. A tray in accordance with claim 6 wherein the rear edge of the bottom-reinforcing panel has hingedly attached thereto a plurality of tabs having ends that are adapted to engage the upper surface of said first and second locking panels and to secure the bottom-reinforcing panel in the formed tray.

8. A tray in accordance with claim 2 wherein the bottom panel member is provided with a slot and each of said first and second locking panels is provided with a tab that protrudes upwardly through the slot.

9. A tray in accordance with claim 8 wherein said slot is elongated with a longitudinal axis that is essentially perpendicular to the front edge of said bottom panel member and said tab associated with each locking panel protrudes upwardly through the slot a sufficient distance to form a divider in said tray.

10. A tray in accordance with claim 2 wherein the bottom panel member is provided with first and second slots and each of said first and second locking panels is provided with a tab that protrudes upwardly through said first and second slots, respectively.

11. A blank for forming a tray in a merchandise display device comprising a sheet of corrugated board having an elongated panel with opposing first and second edges extending along the entire length of the sheet with the elongated panel having a weakened zone along the longitudinal axis of the elongated panel to facilitate folding of the elongated panel, a bottom panel member hingedly attached to said first edge and a bottom-reinforcing panel hingedly attached to said opposing second edge in the central portion of the elongated panel, a pair of locking panels hingedly attached to said first edge of the elongated panel with each locking panel extending from each end of the elongated panel to the point of attachment for the bottom panel member in said central portion of the elongated panel, a pair of connecting panels hingedly attached to said second edge of the elongated panel opposite to said locking panels and to the respective adjacent side edges of said bottom-reinforcing panel, and weakened zones formed in each of said connecting panels to permit folding of the connecting panels and movement of the bottom-reinforcing panel to a position beneath the bottom panel member to form a tray with the folded elongated panel serving as front and side walls of the tray.

12. A blank in accordance with claim 11 wherein the bottom panel member and the bottom-reinforcing panel are each provided with a plurality of attached tabs for engaging support means for holding the formed tray in a predetermined position.

13. A blank in accordance with claim 12 wherein said elongated panel is folded along its longitudinal axis and the surfaces of the elongated panel brought into contact by the folding operation are provided with a layer of adhesive to maintain the elongated panel in a folded state prior to forming a tray from the blank.

14. A blank in accordance with claim 11 wherein said elongated panel is folded along its longitudinal axis and the surfaces of the elongated panel brought into contact by the folding operation are provided with a layer of adhesive to maintain the elongated panel in a folded state prior to forming a tray from the blank.

15. A blank in accordance with claim 14 wherein said bottom panel member is provided with a slot and each of said locking panels includes a hingedly attached tab that is designed for insertion into said slot when the blank is formed into a tray.

16. A blank in accordance with claim 15 wherein the bottom panel member and bottom-reinforcing panel are each provided with a plurality of attached tabs for engaging support means designed to hold the formed tray in a predetermined position.

17. A blank in accordance with claim 14 wherein each of said locking panels includes a hingedly attached tab and said bottom panel member is provided with two spaced apart slots each designed to accommodate the tab associated with the locking panel that is nearest to each respective slot.

18. A blank in accordance with claim 14 wherein said bottom-reinforcing panel is provided with a plurality of slots extending inwardly from the edge of the panel that is opposite to the edge that is attached to said elongated panel, said slots being designed to engage support means associated with a merchandise display device.

19. A blank in accordance with claim 18 wherein said bottom-reinforcing panel is provided with a plurality of hingedly attached tabs that are designed to engage said locking panels when the blank is formed into a tray.

20. A blank in accordance with claim 19 wherein said bottom panel member has a plurality of back panels hingedly attached to the edge of the bottom panel member that is opposite to the edge that is attached to said elongated panel, said back panels being spaced apart from each other a predetermined distance.

21. In a merchandise display device of the type that is fabricated from corrugated board and includes a plurality of trays, the combination comprising support means for holding a plurality of trays in a vertically spaced relationship and a plurality of trays installed in the support means, each of said trays comprising a) a bottom panel member for supporting merchandise, said bottom panel member having opposing first and second side edges and opposing front and rear edges, b) a bottom-reinforcing panel designed to underlie at least a portion of said bottom panel member, said bottom-reinforcing panel having a rear edge, two opposing side edges and a front edge that is essentially parallel to and adjacent to the front edge of said bottom panel member, c) an elongated panel folded along its longitudinal axis and disposed between and attached to the front edge of said bottom panel member and the front edge of said bottom-reinforcing panel, said folded elongated panel extending along the entire length of the front edge of the bottom panel member and projecting generally upwardly a predetermined distance to form a front wall of said tray, d) first and second side walls projecting generally upwardly and positioned in abutting relationship to the respective first and second side edges of the bottom panel member, said first and second side walls comprising folded sections that are continuous with the folded elongated panel extending along the front edge of the bottom panel member, e) first and second locking panels attached to said first and second side walls, respectively, and extending a predetermined distance beneath the bottom panel member, and f) first and second connecting panels attached to said first and second side walls, respectively, and to opposing side edges of said bottom-reinforcing panel, each of said connecting panels being folded and, together with the attached bottom-reinforcing panel, being positioned beneath said locking panels and said bottom panel member.

22. A combination in accordance with claim 21 wherein the folded elongated panel forming the front wall and the first and second side walls of each tray is provided with a layer of adhesive on the surfaces of the folded elongated panel that are brought into contact by folding the panel along its longitudinal axis.

23. A combination in accordance with claim 22 wherein each of said opposing side edges of the bottom-reinforcing panel and each of said opposing first and second side edges of the bottom panel member of each tray is provided with an attached mounting tab, said attached mounting tabs being designed to engage support means associated with said merchandise display device for holding the tray in a desired position.

24. A combination in accordance with claim 22 wherein the bottom panel member of each tray is provided with a slot and each of said first and second locking panels of each tray is provided with a tab that protrudes upwardly through the slot.

25. A combination in accordance with claim 24 wherein said slot is elongated with a longitudinal axis that is essentially perpendicular to the front edge of said bottom panel member and said tab associated with each locking panel protrudes upwardly through the slot a sufficient distance to form a divider in said tray.

* * * * *